United States Patent [19]

Merchant

[11] Patent Number: 4,723,861

[45] Date of Patent: Feb. 9, 1988

[54] BOOKBINDING APPARATUS AND METHOD

[76] Inventor: Larry A. Merchant, 2100 Burchard, SE., Grand Rapids, Mich. 49503

[21] Appl. No.: 25,888

[22] Filed: Mar. 16, 1987

[51] Int. Cl.[4] ..... B42F 3/00; B42F 13/00; B42D 3/04; B41L 1/20

[52] U.S. Cl. ..... 402/8; 402/79; 281/4; 282/9 A

[58] Field of Search ..... 402/8, 13, 19, 73, 62, 402/500; 282/8 A, 8 R, 8 C, 9 A, 9 R, 10, 11, 29 C; 24/153, 153.1, 158; 40/158 R; 156/291, 226, 227

[56] References Cited

U.S. PATENT DOCUMENTS

| | | | |
|---|---|---|---|
| 789,290 | 5/1905 | Norington | 282/9 A |
| 932,365 | 8/1909 | Auscher et al. | 282/9 A |
| 2,139,843 | 12/1938 | Moore | 402/8 |
| 3,460,744 | 8/1969 | Turkenkopf | 281/3 R |
| 3,620,553 | 11/1971 | Donovan | 402/79 |
| 4,605,245 | 8/1986 | Weaver | 281/4 |

*Primary Examiner*—Paul A. Bell
*Assistant Examiner*—Paul M. Heyrana
*Attorney, Agent, or Firm*—Varnum, Riddering, Schmidt & Howlett

[57] ABSTRACT

In a bookbinding apparatus and method, a catalog is bound in book form and includes a back cover having a plurality of equidistantly-spaced openings extending therethrough adjacent an inner edge of the back cover, and a price list includes a substantially double or single width front cover having apertures extending through a free edge thereof and registerable with the openings of the catalog back cover. An elongated flexible strip is woven through the registered openings and apertures to bind the price list to the catalog. When the double or single width front cover is folded upon itself at a center fold thereof, it encompasses the remaining portions of the price list, which include bound pages in book form.

9 Claims, 4 Drawing Figures

BOOKBINDING APPARATUS AND METHOD

FIELD OF THE INVENTION

This invention relates to an apparatus and method for binding books and more particularly to an apparatus and method for binding a price list to a catalog.

DESCRIPTION OF THE PRIOR ART

In the field of bookbinding, there has been a continuing need for a satisfactory method and apparatus for temporarily binding supplemental material in permanently bound publications. For example, in a trade catalog the basic specifications of a given manufacturer's product line may be substantially fixed by industry standards such that there is no significant need for frequent revision of the catalog. The catalog thus may be published several times, although infrequently, and may be permanently bound to provide a durable source of product identification and information.

To minimize catalog publication costs, revisions at publication are avoided to the extent possible, even in industries whose products are inherently subject to frequent changes of product line content, engineering specifications and the like. Thus, it has become the practice to provide in such catalogs only standardized product data, and to supply the product information which is more likely to vary unpredictably in the form of supplemental printed materials which are intended for use along with the catalog.

Although the provision of replaceable catalog supplements may apply to any aspect of a product's specifications, including product line expansion, it is most frequently applied to product pricing, as pricing is the one product specification that is most likely to require revision on a periodic, possibly frequent, and generally unpredictable basis. For this reason, it is common practice in virtually every industry to provide product price lists separate from basic catalogs of product specifications, regardless of the form taken by the basic catalog, whether it be permanently bound, of loose leaf format, or any alternative thereto.

One such alternative, not generally suitable for binding large numbers of pages, is typically found in trade catalogs and comprises a flexible binding strip which is passed through aligned openings in a stack of papers and a front or rear cover of a folder to bind the papers to the folder. The prior art is replete with examples of such strap-type binding systems. For example, U.S. Pat. No. 2,323,393, issued Jul. 6, 1943 to Hartmann, discloses a binder assembly for binding a stack of paper to a folder by a flexible elongated strip, the free ends of which are passed through registered openings in the stack of paper and are then woven through a pair of openings in a backing member mounted to the back cover of the folder.

A similar concept is disclosed in U.S. Pat. No. 1,850,235, issued Mar. 22, 1932 to Kelly, which discloses a stack of carbon paper having a plurality of slots located at spaced locations along an upper edge thereof for registry with similarly disposed slots in upper portions of a carbon paper holder's backing member and front flap. An elongated flexible lace is woven through the respective registered openings and slots to bind the carbon paper to the holder.

Elongated strap elements having free end portions that are threaded through apertures in cover members are also known for use in providing a loose leaf type binder, wherein the strap elements provide the ring structure on which the loose leaf papers are secured between the covers of the binder. Examples of this concept are disclosed in the following U.S. Pat. Nos. 4,256,411, issued Mar. 17, 1981 to Podosek; 3,506,370 issued Apr. 14, 1970 to Smith; and 2,139,843 issued Dec. 13, 1938 to Moore.

Other examples of prior art binders include U.S. Pat. Nos. 4,093,387, issued Jun. 6, 1978 to Jonsson (fastener clip with angled free ends for detachably interconnecting punched documents); 2,253,464, issued Aug. 19, 1941 to Spector (elastic strap with toggles to be used as a binder for sheaves of paper); and 2,001,462 issued May 14, 1935 to Hiller (index cards strung together by strings passed through selected one of a series of holes punched in the edge of each of a plurality of index cards).

In spite of the foregoing, there remains a need in the art for a convenient and effective way to bind in a permanent publication, such as a standard trade or product line catalog, supplemental materials, price lists for example, which are subject to revision and therefore must be periodically replaced.

SUMMARY OF THE INVENTION

According to the invention, there is provided a combination of a first bound volume of printed matter, a second bound volume of printed matter and a binding means for removably binding the second bound volume to the first bound volume.

The first bound volume comprises a plurality of first pages and a back cover having a width, inside and outside edges and a series of spaced openings extending through the back cover and positioned adjacent the inside edge thereof. The back cover is bound to the first bound volume at the inside edge of the back cover.

The second bound volume comprises a plurality of second pages and a front cover having a width greater than that of the back cover, inner and outer portions, with the outer portion having an outer edge, a fold positioned between the inner and outer portions and a series of spaced apertures extending through and positioned adjacent the outer edge of the outer portion. The front cover is bound to the second bound volume at the inner portion of the front cover. In addition, the apertures of the back cover are aligned with the openings of the front cover.

The binding means is cooperable with the back and front covers for binding the front cover to the back cover so as to position the inner portion, the fold and the second pages substantially laterally outwardly from the first pages and to position the outer portion in substantially overlapping relationship to the back cover to thereby permit the first and second pages to be simultaneously laid open and referenced independently. In one embodiment of the invention, the binding means includes an elongated flexible binder extending through the aligned openings and apertures in a predetermined sequence to bind the front cover of the second bound volume to the back cover of the first bound volume. The elongated flexible binder can extend through opposite sides of successive pairs of the aligned openings and apertures. The binder can also include a tapered end to facilitate positioning of the binder through the aligned openings and apertures and an enlarged end to prevent inadvertent disengagement of the binder from the aligned openings and apertures. The aligned openings and apertures can be of uniform size and are equidistantly spaced on the back and front covers, respectively.

There is also provided, according to the invention, a method for removably binding the first bound volume to the second bound volume by the binding means wherein the method comprises positioning the outer portion of the front cover of the second bound volume in overlapping relationship to the back cover of the first bound volume such that the inner portion, the fold and the second pages are positioned substantially laterally outwardly from the first pages of the back cover and the openings are aligned with the apertures; and then binding the outer portion of the front cover to the back cover by positioning the binder through the aligned openings and apertures, in the manner stated above, to bind the outer portion to the back cover.

BRIEF DESCRIPTION OF THE DRAWINGS

The invention will now be described with reference to the accompanying drawings, in which.

DESCRIPTION OF THE PREFERRED EMBODIMENTS

The principles of the invention are disclosed by way of example in a book or other publication, a related supplement therefor and an apparatus for binding the supplement to the publication. For purposes of simplification, the invention will be herein described with reference to a catalog and a supplemental price list 10.

Figure 1:
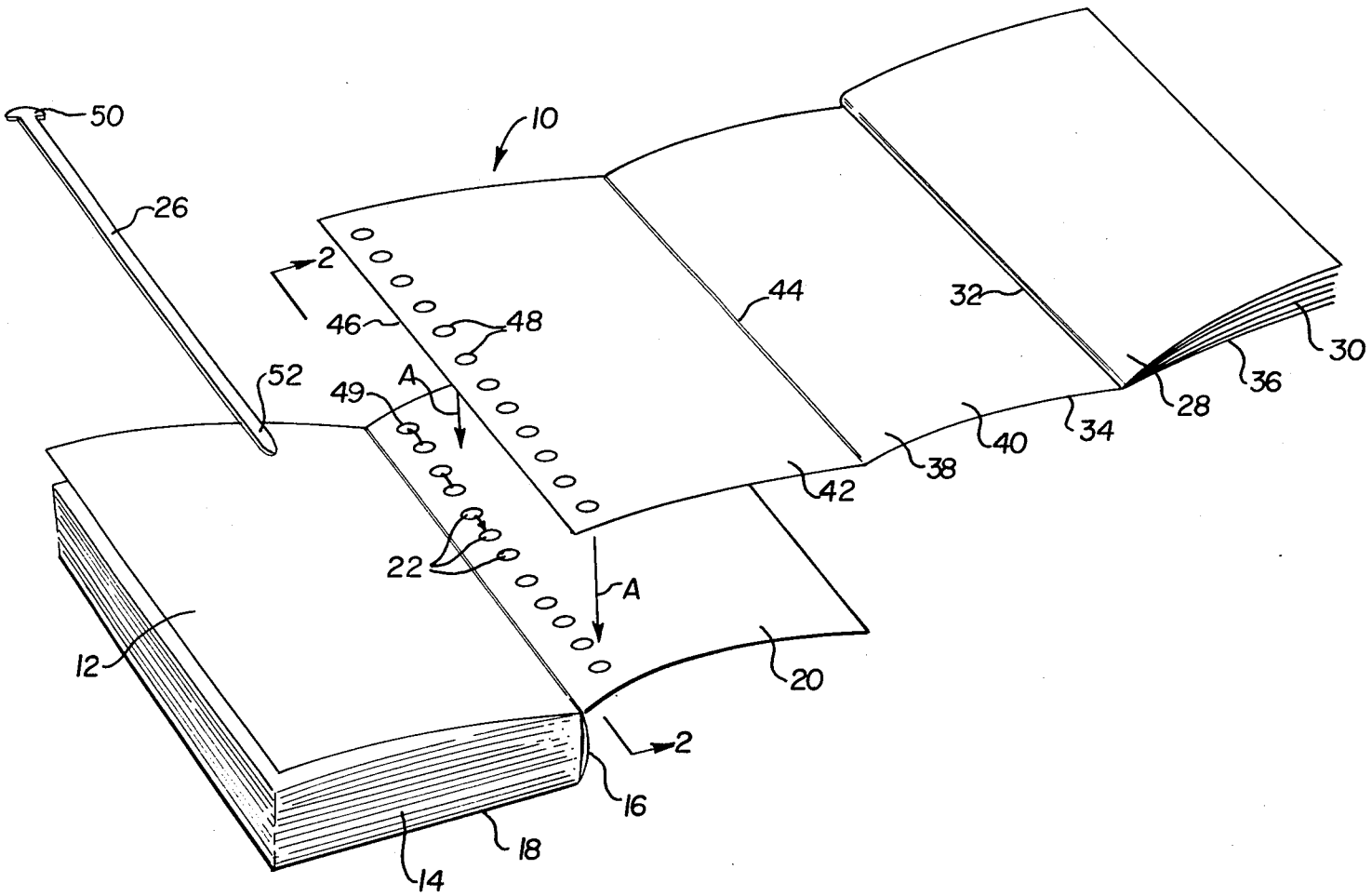
FIG. 1 is an exploded perspective view of a catalog and a price list secured there to according to the invention.

As illustrated in FIG. 1, a catalog 12 comprises a plurality of pages 14, bound by a binder 16, and front and back covers 18, 20, respectively. The back cover 20 includes a series of openings 22 extending therethrough and spaced at equidistant intervals along a line extending generally parallel and adjacent to a bound edge 24 of the back cover 20. The openings 22 are preferably of uniform size and shape and are suitable to receive a free end 52 of an elongated flexible binder strip 26 in the manner below described.

A price list 28 comprises a multiplicity of pages 30 bound together as by stapling, gluing or stitching as at 32. The price list 28 also has bound thereto at 32 a cover 34 which comprises a back cover 36 and a double width front cover 38. The double width front cover 38 includes an inner portion 40 and an outer portion 42, with the inner and outer portions divided along a central fold or crease 44. Each of the inner and outer portions 40, 42 of the front cover 38 has a width substantially equal to the width of pages 30 of the price list 28.

Although the front cover 38 of the price list 28 is preferably of a double width, that is has a width substantially twice that of the back cover 20 of the catalog 12, it is contemplated that the front cover can be of any width substantially equal to or greater than the back cover 20. For example, the front cover can be of a substantially single width. With a single width front cover, the pages 30 could be bound at fold 44, rather than at 32 of the price list, and the front cover 28 of the price list 28 could be bound to the back cover 20 of the catalog by the binder strip adjacent the bound edge 24 of the catalog, at the outer edge of the back cover or anywhere therebetween.

Figure 2:
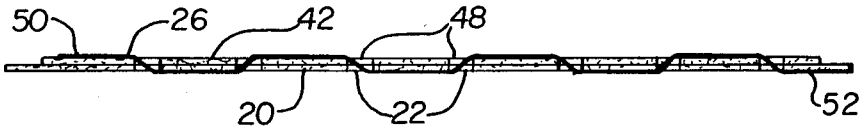
FIG. 2 is a sectional view taken on lines 2—2 of FIG. 1.

Adjacent a free edge 46 of the outer portion 42 of the front cover 38 are a plurality of apertures 48 extending therethrough at equidistant intervals longitudinally of the free edge 46 so as to register with the openings 22 in the catalog back cover 20 when the outer portion of the double width front cover is positioned in overlapping relationship thereto. Accordingly, as shown by arrows A in FIG. 1, the outer portion 42 of the front cover 38 can be positioned in overlapping relationship to the catalog back cover 20 with respective openings and apertures in registry such that binder strip 26 may be passed through successive pairs of registered openings and apertures in sequence as shown in FIG. 2 to be thereby woven or laced therethrough for binding the outer portion 42 of the price list 28 to the back cover 20 of the catalog 12.

The binder strip 26 comprises a head end 50, often referred to as an arrowhead end, and an opposed pointed end 52. The pointed end 52 is passed through the successive pairs of aligned openings and apertures 22, 48 in opposite directions to provide a laced or woven configuration as shown in FIG. 2, until the arrowhead end 50 abuts edges 49 of the first pair of aligned openings and apertures 22, 48 through which the pointed end 52 was initially passed, thus limiting the travel of binder strip 26 and preventing disengagement thereof through inadvertent lacing or weaving thereof through a greater distance than its length can accommodate. Preferably, the overall length of binder strip 26 is sufficient to permit the pointed end 52 thereof to be passed through all of the registered openings and apertures 22, 48 before the head end 50 engages the first pair of aligned openings and apertures in the sequence.

With the catalog 12 and the price list 28 bound together as described above, the price list may be easily removed and replaced with a revised or updated version at any time.

Figure 3:
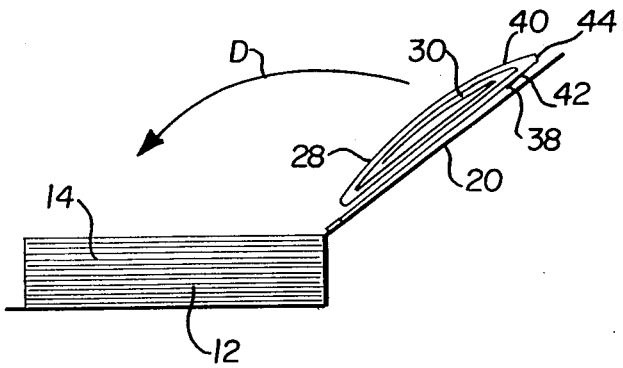
FIG. 3 is an elevational view of the price list mounted to the catalog showing the bound-together catalog and price list in an open position.

As shown in FIG. 3, The double width front cover 38 of price list 28 permits the pages 30 of the price list to be referenced independently of and simultaneously with the pages 14 of catalog the 12. The fold or crease 44 lies outwardly adjacent the catalog pages 14 whereby the pages 30 of price list 28 may be freely turned and referenced independently of and simultaneously with pages 14 of catalog 12. This convenience arises due to the double width of the price list front cover 38 which places the open pages 14 of the catalog 12 and the open pages 30 of the price list 28 laterally adjacent each other in a noninterfering relationship for use.

To close the catalog 10 for storage, the pages 30 of the price list 28 are folded in the direction of arrow B in FIG. 3. The price list 28 is then folded along crease 44 as shown by arrow C in FIG. 3. The pages 14 of catalog 12 also are closed to the configuration shown in FIG. 1 to thereby leave the catalog back cover 20 exposed. The folding motion indicated by arrow C in FIG. 3 is continued to the orientation shown in FIG. 4, wherein the pages 30 of the price list 28 are folded completely within the inner and outer portions 40, 42, respectively, of price list 28. The price list 28 thus lies flat adjacent the catalog back cover 20 as shown in FIG. 4, with the pages 30 of the price list covered and protected by the inner and outer portions 40, 42 of the front cover 38.

Figure 4:
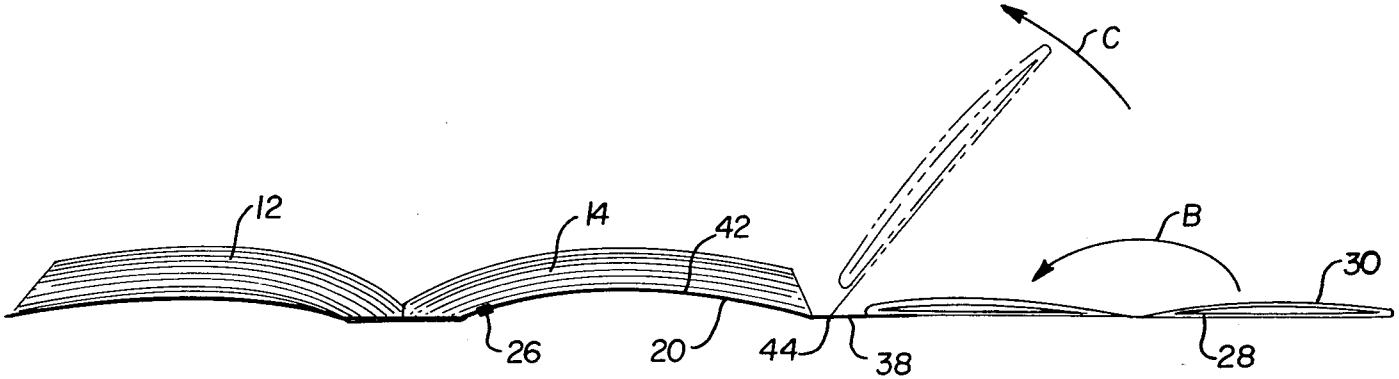
FIG. 4 is an elevational view of the price list mounted to the catalog similar to FIG. 3, but showing the bound-together catalog and price list upon closing thereof.

The back cover 20 of the catalog 12 is then closed as indicated by arrow D in FIG. 4 to completely enfold and contain the price list within the covers 18, 20 of catalog 12.

From the above description the method of the present invention will be apparent, as the description of the apparatus is intended also as a full and enabling description of the method. As described, the method of this invention entails the provision of a printed document such as a catalog having a back cover, and a supplement having a double width front cover with a centerfold or crease, and placement of these respective cover elements in juxtaposed orientation as above described to accommodate interweaving or lacing of an elongated binder strip through a sequence of mutually registered apertures in the respective cover elements to thereby bind the catalog and supplement together.

It will be understood of course that the above description pertains to a presently preferred embodiment of the invention. I have contemplated numerous alternative and modified embodiments other than those described, and such certainly would also occur to others versed in the art, once apprised of my invention. It is therefore my intent that the invention be construed as broadly as permitted by the scope of the claims appended hereto.

The embodiments of the invention in which an exclusive property or privilege is claimed are defined as follows:

1. The combination of a first bound volume of printed matter, a second bound volume of printed matter and a binding means for removably binding said, second bound volume to said first bound volume, wherein:

said first bound volume comprises a plurality of first pages, and a back cover having a width and inside and outside edges and bound to said first bound volume at said inside edge;

said second bound volume comprises a plurality of second pages, and a front cover having a width greater than that of said back cover, inner and outer portions, with said outer portion having an outer edge, and a fold positioned between said inner and outer portions and bound to said second bound volume at said inner portion; and said binding means is cooperable with said back and front covers for binding said front cover to said back cover so as to position said inner-portion, said fold and said second pages substantially laterally outwardly from said first pages and to position said outer portion in substantially overlapping relationship to said back cover to thereby permit said first and second pages to be simultaneously laid open and referenced independently.

2. The combination according to claim 1, wherein said back cover further comprises a series of spaced openings extending therethrough and positioned adjacent said inside edge;

said front cover further comprises a width substantially equal to up to twice that of said back cover, and a series of spaced apertures extending through and positioned adjacent said outer edge of said outer portion of said front cover and aligned with said openings; and said binding means comprises an elongated flexible binder extending through said aligned openings and apertures in a predetermined sequence to bind said front cover of said second bound volume to said back cover of said first bound volume.

3. The combination according to claim 2, wherein said binder extends through opposite sides of successive pairs of said aligned openings and apertures.

4. The combination according to claim 3, wherein said binder further comprises a tapered end to facilitate positioning of said binder through said aligned openings and apertures and an enlarged end to prevent inadvertent disengagement of said binder from said aligned openings and apertures.

5. The combination according to claim 4, wherein said aligned openings and apertures are of uniform size and are spaced on said back and front covers, respectively.

6. The combination according to claim 5, wherein the aligned openings and apertures are equidistantly spaced on said back and front covers, respectively.

7. A method for removably binding a first bound volume of printed matter to a second bound volume of printed matter by a binding means; said first bound volume comprising a plurality of first pages, and a back cover having a width and inside and outside edges; said second bound volume comprising a plurality of second pages, and a front cover having a width greater than that of said second cover, inner and outer portions, with said outer portion having an outer edge, and a fold positioned between said inner and outer portions and bound to said second bound volume at said inner portion; wherein said method comprises:

positioning said outer portion in overlapping relationship to said back cover such that said inner portion, said fold and said second pages are positioned substantially laterally outwardly from said first pages and said back cover; and binding said outer portion to said back cover by said binding means.

8. A method according to claim 6, wherein said first back cover further comprises a series of spaced-apart openings extending through and positioned adjacent said inside edge of said back cover; said front cover further comprises a series of spaced apertures extending through and positioned adjacent said outer edge of said outer portion and alignable with said openings; and said binding means comprises an elongated flexible binder; wherein:

said positioning step further comprises positioning said outer portion in overlapping relationship to said back covers such that said openings are aligned with said apertures; and said binding step further comprises positioning said binder through said aligned openings and apertures in a predetermined sequence to bind said outer portion to said back cover.

9. A method according to claim 8, wherein said binding step further comprises positioning said binder through opposite sides of successive pairs of said aligned openings and apertures.

* * * * *